US008027782B2

(12) United States Patent
Assaf et al.

(10) Patent No.: US 8,027,782 B2
(45) Date of Patent: Sep. 27, 2011

(54) PATTERN RECOGNITION FOR RANDOM MISFIRE

(75) Inventors: Tameem K. Assaf, Milford, MI (US); David S. Mathews, Howell, MI (US); John V Bowman, Farmington, MI (US); Sanjeev M. Naik, Troy, MI (US)

(73) Assignee: GM Global Technology Operations LLC

( * ) Notice: Subject to any disclaimer, the term of this patent is extended or adjusted under 35 U.S.C. 154(b) by 0 days.

(21) Appl. No.: 12/560,739

(22) Filed: Sep. 16, 2009

(65) Prior Publication Data

US 2011/0066358 A1 Mar. 17, 2011

(51) Int. Cl.
*F02D 41/10* (2006.01)

(52) U.S. Cl. ..... 701/111; 123/406.5; 123/436

(58) Field of Classification Search ..... 123/406.27, 123/406.46, 406.5, 406.51, 436, 492; 701/111, 701/110; 73/114.02, 114.03, 114.05
See application file for complete search history.

(56) References Cited

U.S. PATENT DOCUMENTS

| | | | | |
|---|---|---|---|---|
| 5,506,778 | A * | 4/1996 | Matsumoto et al. | 701/111 |
| 5,841,025 | A * | 11/1998 | Remboski et al. | 73/114.05 |
| 6,314,802 | B1 * | 11/2001 | Wu et al. | 73/114.04 |
| 6,388,444 | B1 * | 5/2002 | Hahn et al. | 324/378 |
| 6,847,882 | B2 * | 1/2005 | Miller et al. | 701/111 |
| 6,885,932 | B2 * | 4/2005 | Liu et al. | 701/103 |
| 7,158,875 | B2 * | 1/2007 | Yasui et al. | 701/111 |
| 7,325,446 | B1 * | 2/2008 | Assaf et al. | 73/114.12 |
| 7,359,793 | B2 * | 4/2008 | Galtier et al. | 701/111 |
| 7,591,172 | B2 * | 9/2009 | Lynch et al. | 73/114.05 |
| 7,680,583 | B2 * | 3/2010 | McKay et al. | 701/104 |
| 7,752,900 | B2 * | 7/2010 | Galtier et al. | 73/114.02 |
| 7,765,857 | B2 * | 8/2010 | Suzuki | 73/114.04 |
| 2010/0162803 | A1 * | 7/2010 | Scafati et al. | 73/114.16 |

* cited by examiner

*Primary Examiner* — Hai Huynh

(57) ABSTRACT

A control system includes a jerk determination module and a misfire confirmation module. The jerk determination module determines a jerk of a crankshaft associated with a firing event in an engine. The misfire confirmation module selectively confirms that a misfire detected in the engine is valid based on the jerk.

20 Claims, 6 Drawing Sheets

PATTERN RECOGNITION FOR RANDOM MISFIRE

FIELD

The present invention relates to crankshaft pattern recognition systems and methods for identifying random misfire in an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Vehicles include an internal combustion engine that generates drive torque. More specifically, the engine draws in air and mixes the air with fuel to form a combustion mixture. The combustion mixture is compressed within cylinders and is combusted to drive pistons. The pistons rotatably drive a crankshaft that transfers drive torque to a transmission and wheels. When the engine misfires, the combustion mixture of a cylinder may not combust at all or may combust only partially, and may cause engine vibration and driveline oscillation. A random misfire typically occurs on different cylinders regardless of whether or not they come from consecutive engine cycles.

When a misfire occurs, the speed of the piston can be affected, which in turn can affect the engine speed. Rough roads can also cause changes in engine speed that are similar in magnitude to those generated by engine misfire events. Therefore, rough roads may cause engine misfire detection systems to incorrectly detect engine misfire events.

SUMMARY

A control system includes a jerk determination module and a misfire confirmation module. The jerk determination module determines a jerk of a crankshaft associated with a firing event in an engine. The misfire confirmation module selectively confirms that a misfire detected in the engine is valid based on the jerk.

A method includes determining a jerk of a crankshaft associated with a firing event in an engine, and selectively confirming that a misfire detected in the engine is valid based on the jerk.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
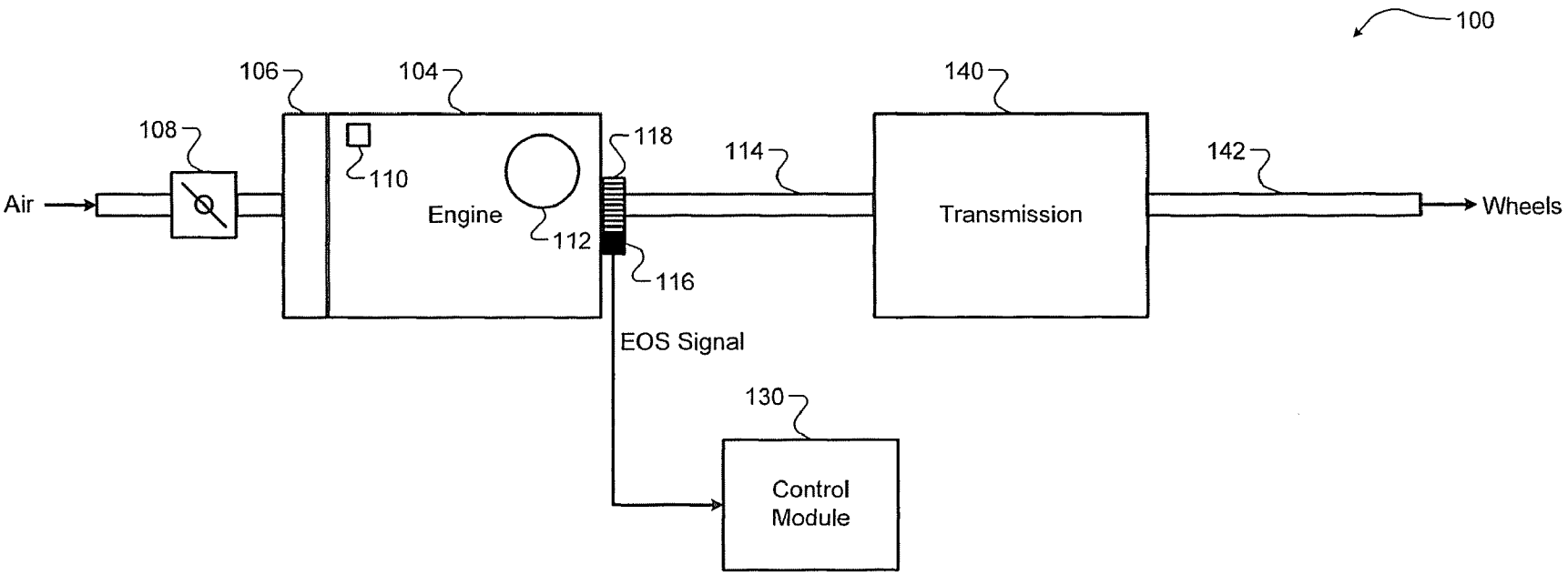
FIG. 1 is a functional block diagram of an exemplary vehicle according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A crankshaft pattern recognition system and method of the present disclosure determines a jerk of a crankshaft for consecutive firing events and identifies misfire based on the jerk. Misfire may be detected when an acceleration of the crankshaft and the jerk of the crankshaft are greater than an acceleration threshold and a jerk threshold, respectively. Detected misfire may be identified as valid based on the jerk determined for the consecutive firing events that occur before, during, and after the misfire occurs. Identifying misfire in this manner improves differentiation between misfire and rough road disturbances.

Referring now to FIG. 1, a functional block diagram of an exemplary vehicle 100 is presented. The vehicle 100 includes an engine 104 that generates torque. The engine 104 may include any suitable type of engine, such as a gasoline internal combustion engine (ICE) or a diesel ICE. For purposes of clarity only, the engine 104 will be discussed as a gasoline ICE.

Air is drawn into the engine 104 through an intake manifold 106. The volume of air drawn into the engine 104 may be varied by a throttle valve 108. One or more fuel injectors 110 mix fuel with the air to form a combustible air-fuel mixture. A cylinder 112 includes a piston (not shown) that is attached to a crankshaft 114. Although the engine 104 is depicted as including one cylinder 112, the engine 104 may include more than one cylinder 112.

Combustion of the air-fuel mixture may include four phases: an intake phase, a compression phase, a combustion phase, and an exhaust phase. During the intake phase, the piston is lowered to a bottom position and the air and fuel are introduced into the cylinder 112. During the compression phase, the air-fuel mixture is compressed within the cylinder 112.

The combustion phase begins when, for example, spark from a spark plug (not shown) ignites the air-fuel mixture. The combustion of the air-fuel mixture causes the piston to rotatably drive the crankshaft 114. This rotational force (i.e., torque) may be the compressive force to compress the air-fuel mixture during the compression phase of another cylinder. Resulting exhaust gas is expelled from the cylinder 112 to complete the exhaust phase and the combustion process.

An engine output speed (EOS) sensor 116 generates an EOS signal based upon, for example, rotation of the crankshaft 114. The EOS sensor 116 may include a variable reluctance (VR) sensor or any other suitable type of EOS sensor. The EOS signal may include a pulse train. Each pulse of the pulse train may be generated when a tooth of an N-toothed wheel 118, which rotates with the crankshaft 114, passes the VR sensor. Accordingly, each pulse may correspond to an angular rotation of the crankshaft 114 by an amount equal to 360° divided by N teeth. The N-toothed wheel 118 may also include a gap of one or more missing teeth.

A misfire of the engine 104 may occur for a number of reasons, such as improper delivery of fuel, air, and/or spark. Misfire may disturb the rotation of the crankshaft 114, thereby causing fluctuations in the EOS signal. A control module 130 determines whether misfire has occurred based upon the EOS signal. The control module 130 may also determine whether engine misfire qualifies as a certain type of engine misfire. For example only, the control module 130 may determine whether engine misfire qualifies as periodic or random.

The engine 104 may transfer torque to a transmission 140 via the crankshaft 114. Torque may be transferred from the engine 104 to the transmission 140 via a torque converter (not shown) if the transmission 140 is an automatic-type transmission. The transmission 140 may transfer torque to one or more wheels (not shown) of the vehicle 100 via a driveshaft 142.

As with misfire, rough road inputs may disturb the rotation of the crankshaft 114, thereby causing fluctuations in the EOS signal. The control module 130 may differentiate misfire and rough road disturbances based on the EOS signal. The control module 130 may determine a jerk of the crankshaft 114 before, during, and after a misfire is suspected to have occurred based on the EOS signal, and may confirm that the misfire is valid based on the jerk.

Figure 2:
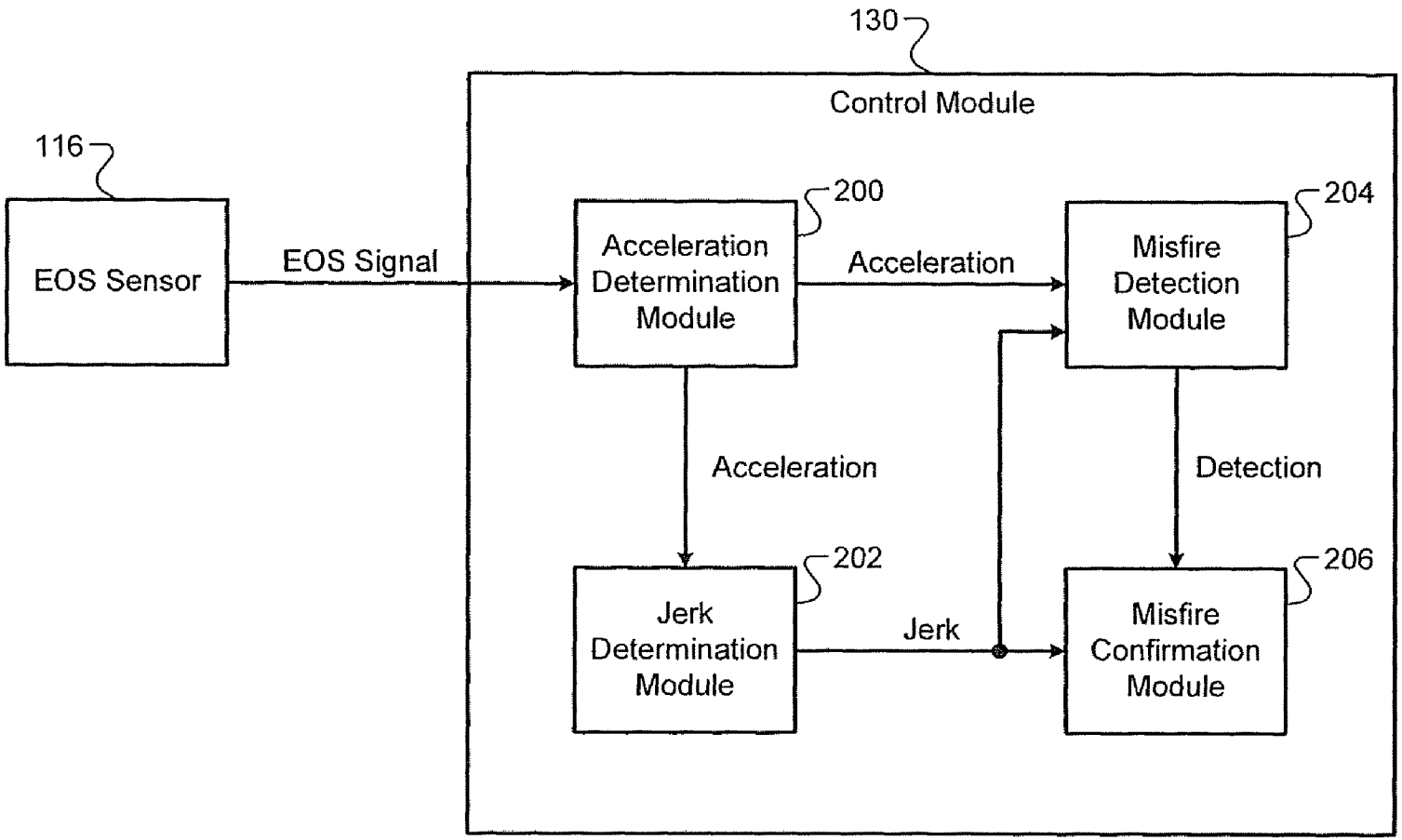
FIG. 2 is a functional block diagram of the exemplary control module of FIG. 1 according to the principles of the present disclosure.

Referring now to FIG. 2, the control module 130 includes an acceleration determination module 200, a jerk determination module 202, a misfire detection module 204, and a misfire confirmation module 206. The acceleration determination module 200 receives the EOS signal from the EOS sensor 116. The acceleration determination module 200 determines an acceleration corresponding to a firing event based on the EOS signal and generates an acceleration signal based on the acceleration determined. The acceleration determination module 200 may determine the acceleration by calculating a first derivative ($d^1[n]$) of the EOS signal.

The jerk determination module 202 receives the acceleration signal from the acceleration determination module 200. The jerk determination module 202 determines a jerk corresponding to the firing event based on the acceleration signal and generates a jerk signal based on the jerk determined. The jerk determination module 202 determines the jerk by calculating the first derivative of the acceleration signal. The first derivative of the acceleration signal is equivalent to a second derivative ($d^2[n]$) of the EOS signal.

The misfire detection module 204 receives the acceleration signal from the acceleration determination module 200 and receives the jerk signal from the jerk determination module 202. The misfire detection module 204 detects a misfire of the firing event based on the acceleration signal and the jerk signal. For example, the misfire detection module 204 may detect the misfire when the acceleration and the jerk are greater than an acceleration threshold and a jerk threshold, respectively. The acceleration threshold and the jerk threshold may be predetermined. The misfire detection module generates a detection signal based on the misfire detected.

The misfire confirmation module 206 receives the jerk signal from the jerk determination module 202 and receives the detection signal from the misfire detection module 204. The misfire confirmation module 206 confirms that a detected misfire is valid based on the jerk. The misfire confirmation module 206 may confirm the detected misfire based on the jerk corresponding to firing events that occur before, during, and after the detected misfire occurs. The misfire confirmation module 206 may confirm the detected misfire when crankshaft pattern conditions are recognized based on the jerk.

The jerk determination module 202 may determine a misfire jerk ($d^2[m]$) for the detected misfire, a preceding jerk ($d^2[m-1]$) for the firing event that precedes the detected misfire, and first, second, and third subsequent jerks ($d^2[m+1]$, $d^2[m+2]$, $d^2[m+3]$) for the firing events that follow the detected misfire and are consecutive in a firing order. The misfire confirmation module 206 may confirm that the detected misfire is valid based on the misfire jerk, the preceding jerk, and the first, second, and third subsequent jerks.

The misfire confirmation module 206 may confirm that the detected misfire is valid when crankshaft pattern conditions are satisfied. The misfire confirmation module 206 may determine that crankshaft pattern conditions are satisfied when a first jerk condition and/or a second jerk condition are satisfied and only one misfire is detected during the engine cycle that corresponds to the detected misfire. The first jerk condition is satisfied when a difference between the second subsequent jerk and the first subsequent jerk is greater than a first jerk threshold ($K_1$*Th), represented in Equation 1 below.

$$d^2[m+2]-d^2[m+1]>K_1*Th \quad (1)$$

The second jerk condition is satisfied when a difference between the third subsequent jerk and the second subsequent jerk is less than a second jerk threshold ($K_2$*Th), represented in Equation 2 below.

$$d^2[m+3]-d^2[m+2]<K_2*Th \quad (2)$$

The first jerk threshold and the second jerk threshold include a first constant ($K_1$) and a second constant ($K_2$), respectively. The first constant ($K_1$) and the second constant ($K_2$) may be predetermined to differentiate between misfire and rough road disturbances, as discussed in more detail below. The first jerk threshold and the second jerk threshold also include a threshold function that varies based on engine speed and engine load.

The misfire confirmation module 206 may confirm that the detected misfire is valid based on a recognized pattern counter and a unrecognized pattern counter. The misfire confirmation module 206 may increment the recognized pattern counter when a third jerk condition and a fourth jerk condition are satisfied. The third jerk condition is satisfied when the misfire jerk is greater than the preceding jerk, represented in Equation 3 below.

$$d^2[m]>d^2[m-1] \quad (3)$$

The fourth jerk condition is satisfied when an absolute difference between the third subsequent jerk and the second subsequent jerk is less than a third jerk threshold, represented in Equation 4 below.

$$|d^2[m+3]-d^2[m+2]|<K_3*Th \quad (4)$$

While Equation 4 analyzes the absolute difference between the third subsequent jerk and the second subsequent jerk, Equation 4 may be modified to analyze an absolute difference between jerk values corresponding to other consecutive firing events based on the number of cylinders in an engine. For example, Equation 4 may be modified for an eight-cylinder engine to analyze an absolute difference between the jerk values corresponding to a fourth subsequent firing event and the third subsequent firing event.

The third jerk threshold may include a third constant ($K_3$) and the threshold function. The third constant may be predetermined to differentiate between misfire and rough road disturbances, as discussed in more detail below.

The misfire confirmation module 206 may confirm that the detected misfire is valid when a predetermined number of engine cycles have been completed. For example, the misfire confirmation module 206 may validate misfire detection data when 100 engine cycles have been completed.

The misfire confirmation module 206 may determine whether the misfire is periodic or random and confirm that the misfire is valid when the misfire is random. The misfire is periodic when at least a predetermined portion of the misfire detection data corresponds to only one cylinder. The misfire is random when the misfire detection data corresponds to more than one cylinder.

The misfire confirmation module 206 may confirm that the detected misfire is valid based on the recognized pattern counter and the unrecognized pattern counter. The misfire confirmation module 206 may determine that the detected misfire is valid when a ratio of the unrecognized pattern counter to the recognized pattern counter is less than or equal to a pattern recognition threshold. The pattern recognition threshold may be predetermined to differentiate between misfire and rough road disturbances.

Figure 3:
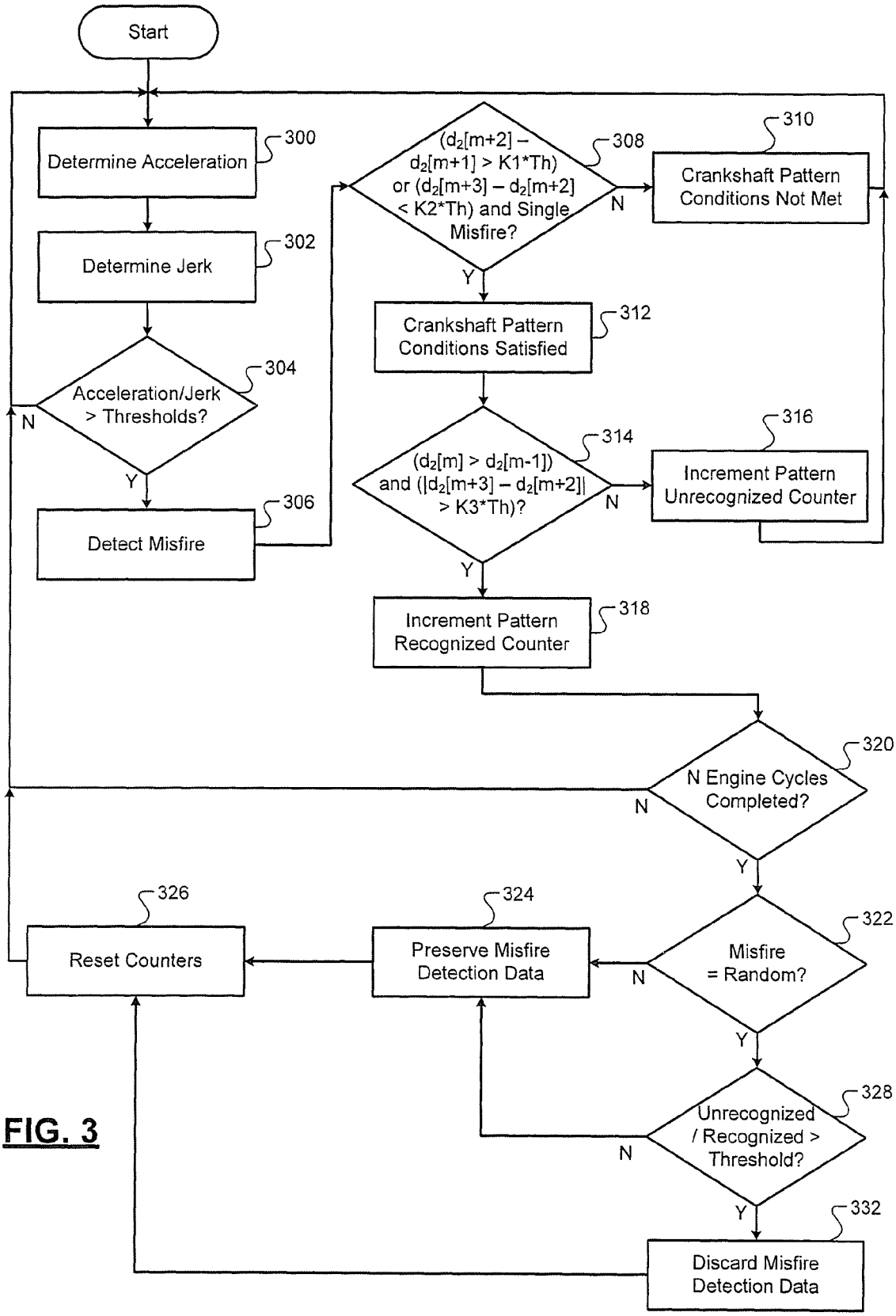
FIG. 3 is a flowchart depicting exemplary steps of a control method according to the principles of the present disclosure.

Referring now to FIG. 3, control determines an acceleration of a crankshaft and a jerk of the crankshaft in steps 300 and 302, respectively. Control determines whether the acceleration and the jerk are greater than an acceleration threshold and a jerk threshold, respectively, in step 304. Control returns to step 300 when the acceleration and/or jerk are less than or equal to the acceleration threshold and the jerk threshold, respectively. Control detects a misfire in step 306 when the acceleration and the jerk are greater than the acceleration threshold and the jerk threshold, respectively.

Referring again to step 302, control may determine a misfire jerk ($d^2[m]$) for the detected misfire, a preceding jerk ($d^2[m-1]$) for the firing event that precedes the detected misfire, and first, second, and third subsequent jerks ($d^2[m+1]$, $d^2[m+2]$, $d^2[m+3]$) for the firing events that follow the detected misfire and are consecutive in a firing order.

In step 308, control determines whether a first jerk condition and/or a second jerk condition are satisfied and whether a single misfire has occurred during an engine cycle that corresponds to the detected misfire. The first jerk condition and the second jerk condition are respectively defined in Equations 1 and 2 above.

Control determines that crankshaft pattern conditions are not satisfied in step 310 and returns to step 300 when neither the first jerk condition nor the second jerk condition are satisfied or when multiple misfires occur during the engine cycle. Control determines that crankshaft pattern conditions are satisfied in step 312 and proceeds to step 314 when the first jerk condition and/or the second jerk condition are satisfied and only one misfire has occurred during the engine cycle.

Control may increment a pattern conditions unsatisfied counter when the crankshaft pattern conditions are not satisfied. This counter may be used to improve differentiation between misfire and rough road disturbances based on dynamics of a particular vehicle. For example, the first and second jerk thresholds may be adjusted when the pattern conditions unsatisfied counter is higher or lower than expected based on other vehicle applications.

Control determines whether third and fourth jerk conditions are satisfied in step 314. The third and fourth jerk conditions are respectively defined in Equations 3 and 4 above. Control increments a unrecognized pattern counter in step 316 when either the third jerk condition or the fourth jerk condition is not satisfied. Control increments a recognized pattern counter in step 318 when the third and fourth jerk conditions are satisfied.

Control determines whether a predetermined number (N) of engine cycles have been completed in step 320. Control returns to step 300 when the predetermined number of engine cycles have not been completed. Control proceeds to step 322 when the predetermined number of engine cycles have been completed.

Control may determine whether the detected misfire is random in step 322 based on misfire detection data collected for the predetermined number of engine cycles. Control may determine that the detected misfire is random when the misfire detection data corresponds to more than one cylinder. Control may proceed to step 324 when the suspected misfire is not random and may proceed to step 328 when the suspected misfire is random.

Alternatively, control may determine whether the detected misfire is periodic. Control may determine that the detected misfire is periodic when at least a predetermined portion of the misfire detection data corresponds to only one cylinder. Control may proceed to step 324 when the detected misfire is periodic and proceed to step 328 when the detected misfire is not periodic.

In step 324, control preserves (i.e., does not discard) misfire detection data. In this manner, control confirms that the detected misfire is valid. Control resets all counters in step 326, including the recognized pattern counter and the unrecognized pattern counter, then returns to step 300.

In step 328, control determines whether a ratio of the unrecognized pattern counter to the recognized pattern counter is greater than a pattern recognition threshold. Control proceeds to step 324, thereby confirming that the detected misfire is valid, when the ratio of the unrecognized pattern counter to the recognized pattern counter is less than or equal to the pattern recognition threshold. Control discards the misfire detection data in step 332, thereby confirming that the detected misfire is invalid, when the ratio of the unrecognized pattern counter to the recognized pattern counter is greater than the pattern recognition threshold.

Referring now to FIGS. 4-8, operation of an engine during a random misfire is illustrated. The y-axis represents crankshaft acceleration, or a first derivative ($d^1[n]$) of an engine output speed (EOS) signal. The x-axis represents crankshaft jerk, or a second derivative ($d^2[n]$) of the EOS signal.

The EOS signal is in the time domain. Thus, the upper right hand quadrant reflects a decreasing engine speed and acceleration, and the lower left hand quadrant reflects an increasing engine speed and acceleration. Crankshaft acceleration is plotted against a misfire jerk ($d^2[m]$) for a suspected misfire, a preceding jerk ($d^2[m-1]$) for a preceding firing event that precedes the suspected misfire, and first, second, and third subsequent jerks ($d^2[m+1]$, $d^2[m+2]$, $d^2[m+3]$) respectively for first, second, and third subsequent firing events that follow the suspected misfire and are consecutive in a firing order.

Figure 4:
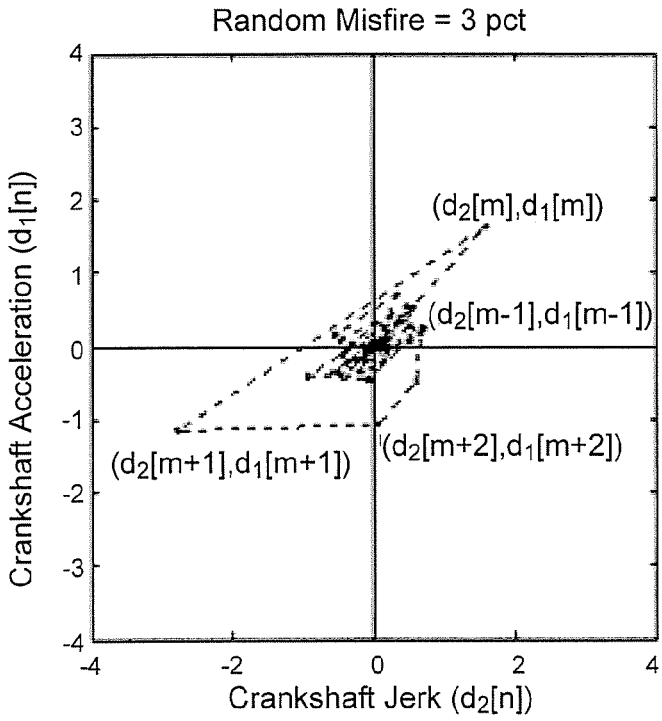
FIG. 4 illustrates operation of an engine during a random misfire.

Referring now to FIG. 4, crankshaft jerk before and after the suspected misfire may be used to differentiate authentic misfire from rough road disturbances. Crankshaft jerk generally increases when a misfire occurs due to a high frequency deceleration caused by the misfire. However, rough road disturbances may cause the preceding jerk to be greater than the misfire jerk. Thus, a condition where the misfire jerk is greater than the preceding jerk, as in Equation 3 above, may be used to differentiate misfire from rough road.

An engine generally accelerates after a misfire occurs to compensate for a loss of torque due to the misfire. This increase in acceleration generally causes the first subsequent jerk to be negative, as energy is input to the crankshaft. At the second subsequent firing event, the engine decelerates to the origin to compensate for aggressive acceleration in the previous event. Thus, a condition where a difference between the second subsequent jerk and the first subsequent jerk is greater than a first jerk threshold ($K_1$*Th), as in Equation 1 above, may be used to confirm that the suspected misfire is valid.

The first jerk threshold may be a product of a first constant ($K_1$) and a threshold function (Th). The first constant may be used to offset the first jerk threshold based on predicted behavior of the crankshaft after a misfire. The threshold function may vary based on engine speed and engine load.

Figure 5:
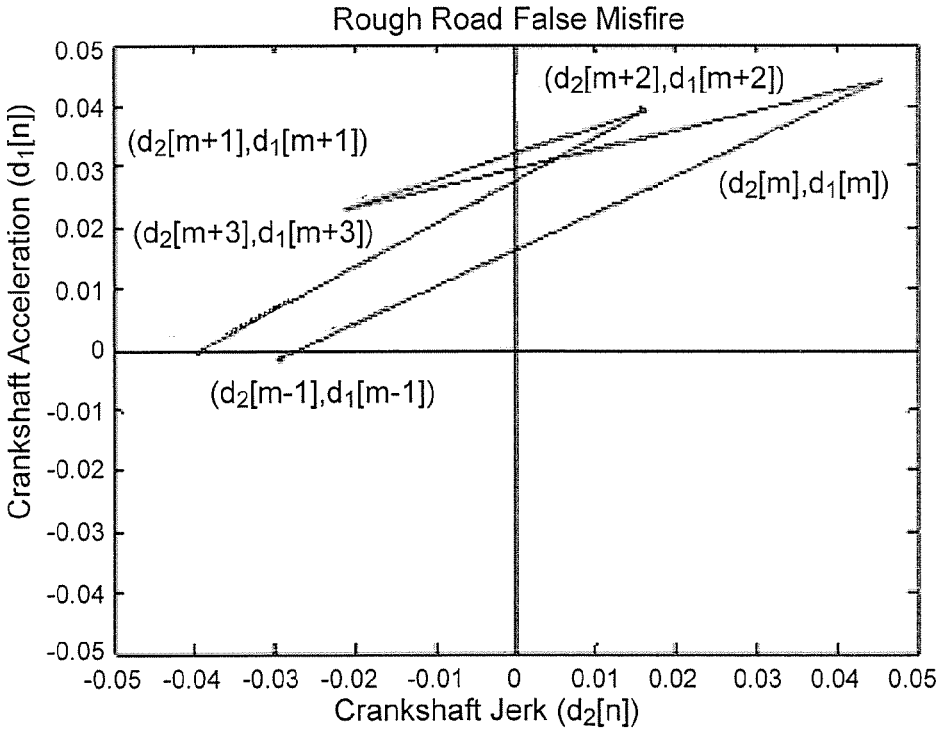
FIG. 5 illustrates operation of the engine during a high frequency rough road disturbance.

Referring now to FIG. 5, operation of an engine during a high frequency rough road disturbance is illustrated. As shown in FIG. 5, a high frequency rough road disturbance may satisfy the condition represented in Equation 1.

Figure 6:
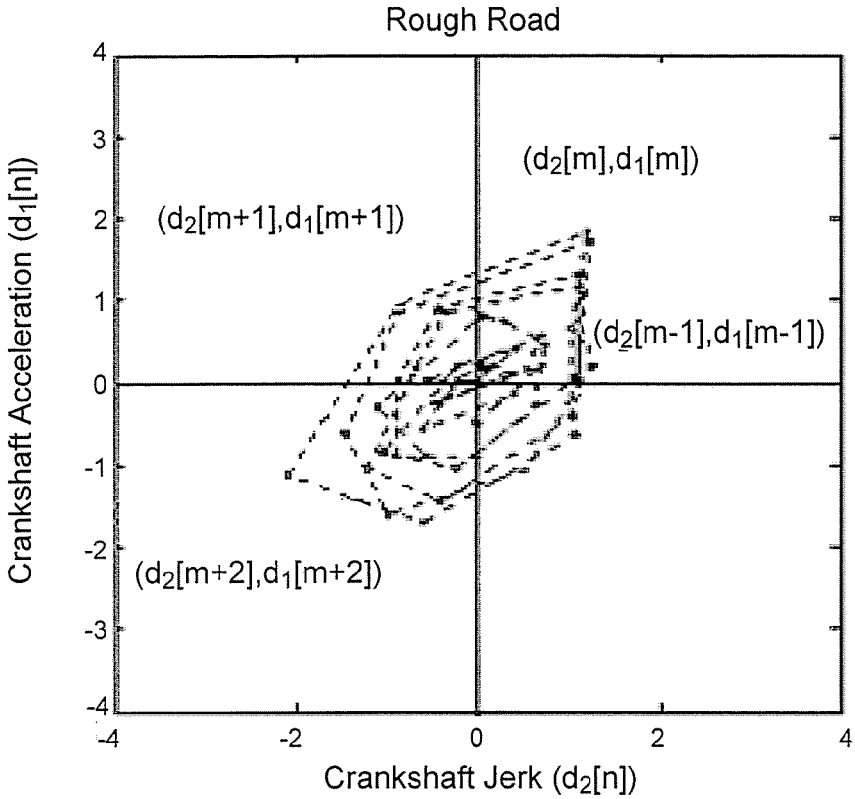
FIG. 6 illustrates operation of the engine during a low frequency rough road disturbance.

Referring now to FIG. 6, operation of an engine during a low frequency rough road disturbance is illustrated. The low frequency rough road disturbance does not satisfy the condition represented in Equation 1. This is because a lower rough road frequency results in a lower response frequency. Thus, a high frequency rough road disturbance is more likely to resemble a misfire as compared to a low frequency rough road disturbance.

Figure 7:
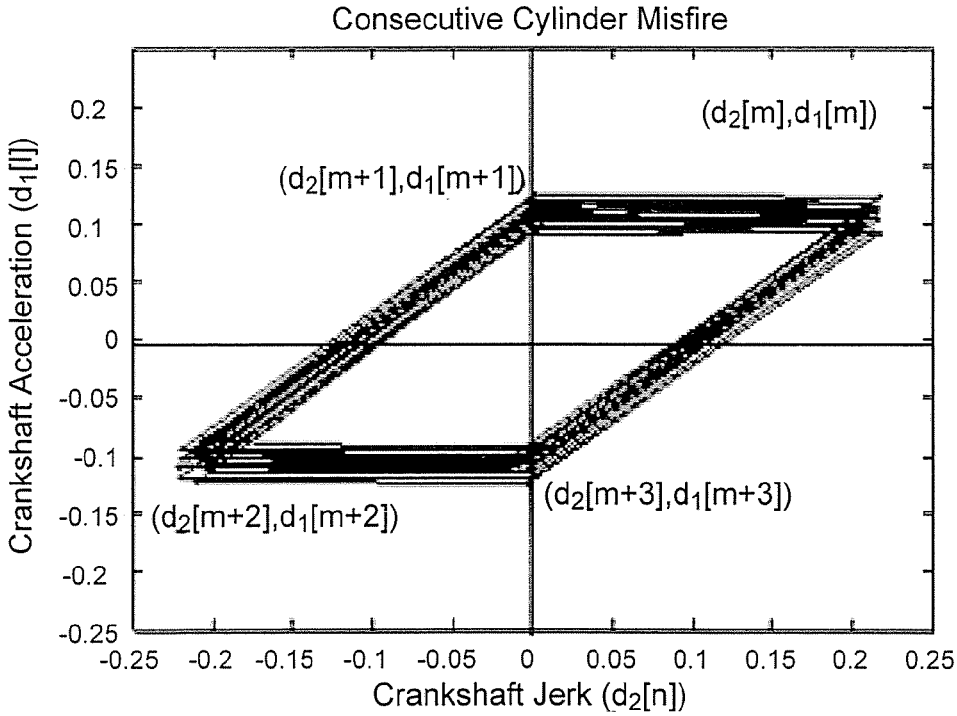
FIG. 7 illustrates operation of the engine during a consecutive cylinder misfire.

Referring now to FIG. 7, operation of the engine during a consecutive or sequential cylinder misfire is illustrated. Sequential cylinder misfire does not exhibit the same behavior as single cylinder misfire because sequential cylinder misfire involves a deceleration that immediately follows the initial deceleration due to the misfire. Thus, the second subsequent jerk may be less than the first subsequent jerk. In this instance, the condition defined in Equation 1 above may not be satisfied when either sequential misfire or rough road disturbance occur.

However, a misfiring engine generally exhibits a significantly higher response frequency for acceleration and deceleration following a misfire. An engine may still be accelerating or slowly decelerating at a third subsequent firing event following a rough road disturbance. In contrast, an engine generally aggressively decelerates at a third subsequent firing event following a sequential misfire to compensate for acceleration at the second subsequent firing event. Thus, a condition where a difference between the third subsequent jerk and the second subsequent jerk is greater than a second jerk threshold ($K_2$*Th), as in Equation 2 above, may be used to differentiate sequential misfire from rough road disturbances.

Figure 8:
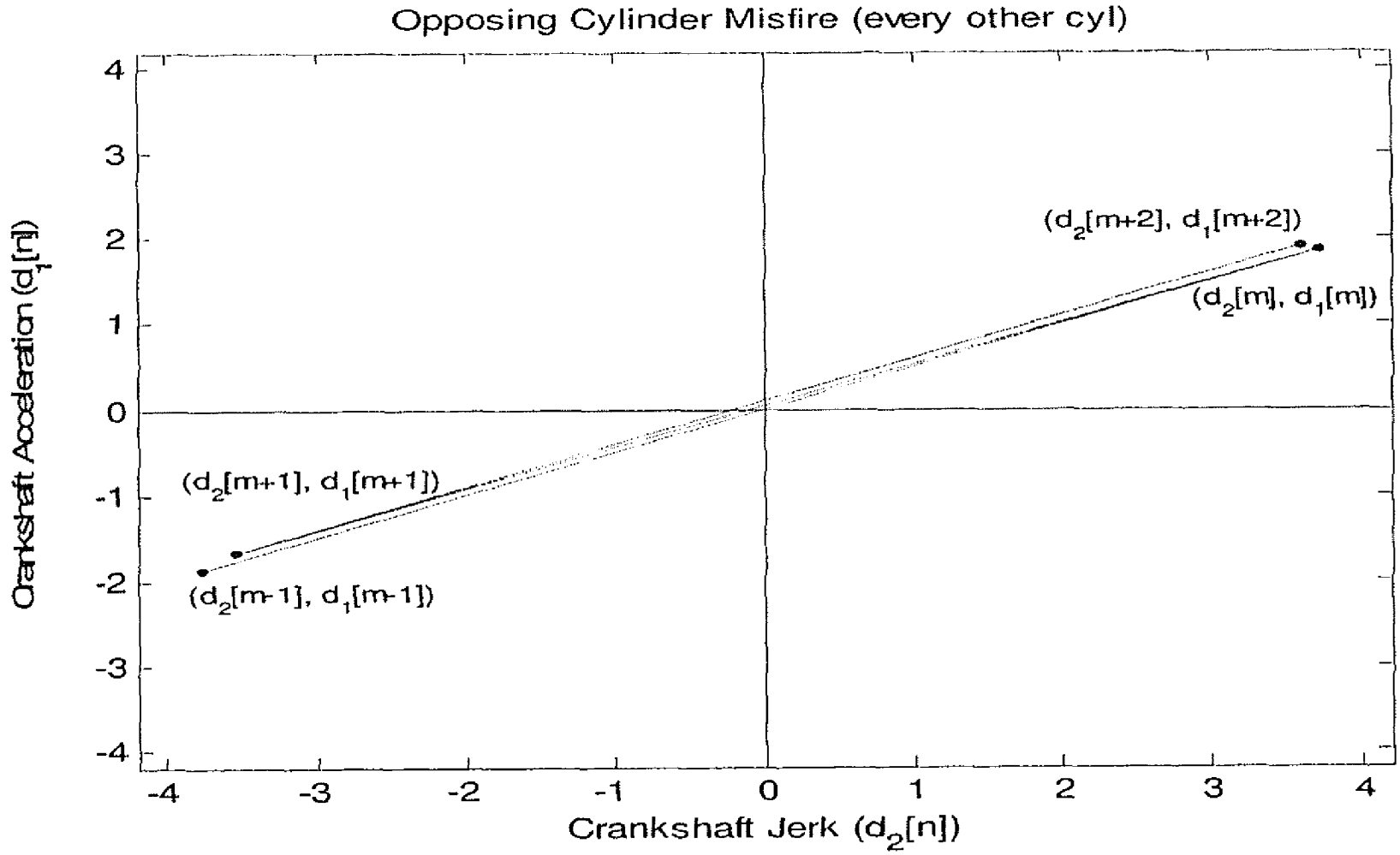
FIG. 8 illustrates operation of the engine during an opposing cylinder misfire.

Referring now to FIG. 8, operation of the engine during an opposing cylinder or non-sequential misfire is illustrated. Non-sequential misfire may be multiple misfires that occur during an engine cycle and are not consecutive in a firing order, as shown in FIG. 8. While the conditions defined in Equations 1-3 above may be used to differentiate sequential misfire from rough road disturbances, additional criteria may be used to differentiate non-sequential misfire from rough road disturbances.

A difference between the third subsequent jerk and the second subsequent jerk is generally lower following non-sequential misfire as compared to the difference following rough road disturbances. This is because the engine is only compensating for one excitation following non-sequential misfire. In contrast, during rough road, the engine must generally compensate for multiple excitations that decay at various rates. Thus, a condition where an absolute difference between the third subsequent jerk and the second subsequent jerk is greater than a third jerk threshold ($K_3$*Th), as in Equation 4 above, may be used to differentiate non-sequential misfire from rough road disturbances.

The third jerk threshold may be a product of a third constant ($K_3$) and the threshold function (Th). The third constant may be adjusted based on whether the suspected misfire has occurred during consecutive engine cycles. The third constant should be higher when the suspected misfire has occurred during consecutive engine cycles because the oscillations due to the misfire do not have sufficient time to be dampened. The third constant may be adjusted by switching between a maximum constant ($K_{max}$) and a minimum constant ($K_{min}$).

While the condition defined in Equation 4 may be used to differentiate non-sequential misfire from rough road disturbances, the condition may not be satisfied for some non-sequential misfire such as when misfire occurs at the second subsequent firing event. Moreover, the condition may only be used to validate misfire detection data when only one misfire occurs during each engine cycle. Thus, a determination may be made to ensure that crankshaft pattern conditions are met before confirming that misfire is valid using Equation 4. The crankshaft pattern conditions may be met when multiple non-consecutive misfires do not occur within a single engine cycle and when only one misfire occurs during each engine cycle.

In addition, the condition defined in Equation 4 may not be satisfied in the event of a severe imbalance between cylinders that correspond to the second subsequent firing event and the third subsequent firing event. A random misfire may reduce the likelihood that the second subsequent jerk and the third subsequent jerk will correspond to the imbalanced cylinders. Thus, to minimize the impact of a severe imbalance, the condition may only be used to confirm that a suspected misfire is valid when the suspected misfire is random.

A determination of whether the suspected misfire is random or periodic may be made after a predetermined number of engine cycles have occurred. For example, a determination may be made that the suspected misfire is random at an end of a 100 engine cycle test.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

a jerk determination module that determines a jerk of a crankshaft associated with a firing event in an engine; and a misfire confirmation module that selectively confirms that a misfire detected in the engine is valid based on the jerk, wherein the jerk is a time derivative of an acceleration of the crankshaft associated with the firing event.

2. The control system of claim 1, further comprising:

an acceleration determination module that determines the acceleration of the crankshaft associated with the firing event; and a misfire detection module that detects the misfire when at least one of the acceleration and the jerk are greater than an acceleration threshold and a jerk threshold, respectively.

3. The control system of claim 2, wherein the jerk determination module determines a misfire jerk associated with the detected misfire, a preceding jerk associated with a preceding firing event that precedes the misfire, and first, second, and third subsequent jerks respectively associated with first, second, and third subsequent firing events that follow the detected misfire and are consecutive in a firing order.

4. The control system of claim 3, wherein the misfire confirmation module determines that crankshaft pattern conditions are satisfied when at least one of a first jerk condition and a second jerk condition is satisfied and a single misfire is detected during an engine cycle that corresponds to the detected misfire, and wherein the first jerk condition is satisfied when a first difference between the second subsequent jerk and the first subsequent jerk is greater than a first jerk threshold, and wherein the second jerk condition is satisfied when a second difference between the third subsequent jerk and the second subsequent jerk is less than a second jerk threshold.

5. The control system of claim 4, wherein the misfire confirmation module increments a recognized pattern counter when the crankshaft pattern conditions are satisfied, a third jerk condition is satisfied, and a fourth jerk condition is satisfied, wherein the third jerk condition is satisfied when the misfire jerk is greater than the preceding jerk, and wherein the fourth jerk condition is satisfied when an absolute difference between the third subsequent jerk and the second subsequent jerk is less than a third jerk threshold.

6. The control system of claim 5, wherein the misfire confirmation module increments an unrecognized pattern counter when the crankshaft pattern conditions are satisfied and at least one of the third jerk condition and the fourth jerk condition are not satisfied.

7. The control system of claim 6, wherein the misfire confirmation module selectively confirms that the detected misfire is valid when the engine has completed a predetermined number of engine cycles.

8. The control system of claim 7, wherein the misfire confirmation module selectively confirms that the detected misfire is valid based on the recognized pattern counter and the unrecognized pattern counter.

9. The control system of claim 8, wherein the misfire confirmation module confirms that the detected misfire is valid when the detected misfire is random and a ratio of the unrecognized pattern counter to the recognized pattern counter is less than or equal to a predetermined threshold.

10. The control system of claim 9, wherein the misfire confirmation module determines that the detected misfire is random when the detected misfire is associated with more than one cylinder in the engine.

11. A method, comprising:

determining a jerk of a crankshaft associated with a firing event in an engine; and selectively confirming that a misfire detected in the engine is valid based on the jerk, wherein the jerk is a time derivative of an acceleration of the crankshaft associated with the firing event.

12. The method of claim 11, further comprising:

determining the acceleration of the crankshaft associated with the firing event; and detecting the misfire when at least one of the acceleration and the jerk are greater than an acceleration threshold and a jerk threshold, respectively.

13. The method of claim 12, further comprising determining a misfire jerk associated with the detected misfire, a preceding jerk associated with a preceding firing event that precedes the misfire, and first, second, and third subsequent jerks respectively associated with first, second, and third subsequent firing events that follow the detected misfire and are consecutive in a firing order.

14. The method of claim 13, further comprising determining that crankshaft pattern conditions are satisfied when at least one of a first jerk condition and a second jerk condition is satisfied and a single misfire is detected during an engine cycle that corresponds to the detected misfire, and wherein the first jerk condition is satisfied when a first difference between the second subsequent jerk and the first subsequent jerk is greater than a first jerk threshold, and wherein the second jerk condition is satisfied when a second difference between the third subsequent jerk and the second subsequent jerk is less than a second jerk threshold.

15. The method of claim 14, further comprising incrementing a recognized pattern counter when the crankshaft pattern conditions are satisfied, a third jerk condition is satisfied, and a fourth jerk condition is satisfied, wherein the third jerk condition is satisfied when the misfire jerk is greater than the preceding jerk, and wherein the fourth jerk condition is satisfied when an absolute difference between the third subsequent jerk and the second subsequent jerk is less than a third jerk threshold.

16. The method of claim 15, further comprising incrementing an unrecognized pattern counter when the crankshaft pattern conditions are satisfied and at least one of the third jerk condition and the fourth jerk condition are not satisfied.

17. The method of claim 16, further comprising selectively confirming that the detected misfire is valid when the engine has completed a predetermined number of engine cycles.

18. The method of claim 17, further comprising selectively confirming that the detected misfire is valid based on the recognized pattern counter and the unrecognized pattern counter.

19. The method of claim 18, further comprising confirming that the detected misfire is valid when the detected misfire is random and a ratio of the unrecognized pattern counter to the recognized pattern counter is less than or equal to a predetermined threshold.

20. The method of claim 19, further comprising determining that the detected misfire is random when the detected misfire is associated with more than one cylinder in the engine.

* * * * *